US005524660A

United States Patent [19]

Dugan

[11] Patent Number: 5,524,660

[45] Date of Patent: Jun. 11, 1996

[54] PLATE-TYPE SPRAY NOZZLE AND METHOD OF USE

[75] Inventor: Jeffrey S. Dugan, Asheville, N.C.

[73] Assignee: BASF Corporation, Mount Olive, N.J.

[21] Appl. No.: 496,169

[22] Filed: Jun. 28, 1995

[51] Int. Cl.[6] ..... F15C 3/14

[52] U.S. Cl. ..... 137/14; 137/826; 137/833; 137/835

[58] Field of Search ..... 137/835, 826, 137/833

[56] References Cited

U.S. PATENT DOCUMENTS

| | | | |
|---|---|---|---|
| 3,016,066 | 1/1962 | Warren | 137/835 |
| 3,158,166 | 11/1964 | Warren | 137/835 |
| 3,432,357 | 3/1969 | Dankese | 136/86 |
| 3,557,814 | 1/1971 | Neradka | 137/835 |
| 3,942,558 | 3/1976 | Honda et al. | 137/826 |
| 4,167,873 | 9/1979 | Bahrton | 137/835 |
| 4,231,519 | 11/1980 | Bauer | 137/826 |
| 4,647,212 | 3/1987 | Hankison | 366/165 |
| 4,976,155 | 12/1990 | Challandes | 137/826 |
| 5,014,750 | 5/1991 | Winchell et al. | 138/43 |
| 5,176,360 | 1/1993 | Winchell et al. | 251/127 |

OTHER PUBLICATIONS

"Fluid Amplifiers", *Fluidics*, E. F. Humphrey and D. H. Tarumoto, Fluid Amplifier Associates, Boston, MA, 1965, esp. pp. 11–16.

*Primary Examiner*—A. Michael Chambers

[57] ABSTRACT

A plate-type nozzle and a method of using same to atomize a liquid are disclosed, wherein the nozzle contains at least one nozzle plate having formed on a common facial surface thereof at least one atomization chamber containing: an inlet for a liquid stream; a jet-forming channel downstream of and in fluid communication with the inlet, the jet-forming channel being adapted to convert the stream into a jet; an interaction channel downstream of and in fluid communication with the jet-forming channel and having opposite first and second sides, the jet passing between the first and second sides and forming an attachment to either the first or second side; a split path having first and second branch channels associated with the respective first and second sides of the interaction channel, wherein attachment to the first side causes the jet to flow entirely into the first branch channel while attachment to the second side causes the jet to flow entirely into the second branch channel; at least one control channel in fluid communication with the interaction channel at the first and second sides; wherein an oscillating pressure wave is induced in the control channel, causing the attachment of the jet to switch back-and-forth between the first and second sides, respectively, to cause the jet to form substantially discrete liquid volumes in the first and second branch channels; and one or more outlet ports in communication with the branch channels for the liquid volumes, the volumes exiting the one or more outlet ports as substantially discrete atomized drops.

33 Claims, 3 Drawing Sheets

PLATE-TYPE SPRAY NOZZLE AND METHOD OF USE

BACKGROUND OF THE INVENTION

This invention relates to a plate-type nozzle and a method of using same. More particularly, this invention relates to a plate-type spray nozzle for atomizing liquids and a method of using same.

Atomized liquids are useful in a wide variety of household and industrial applications including, for example, medicinal sprays, spray drying, surface coating, ink jet printing, and liquid fuel dispersion for combustion.

Frequently, liquids are atomized by means of nozzles having bulky, complicated structures which are relatively expensive and time-consuming to make, clean, inspect, re-use and/or replace. On the other hand, nozzles having a plate-like configuration have been used to direct fluid flow are believed to have less complicated and less bulky structures than do non-plate nozzles and are, therefore, often preferred over the bulkier non-plate nozzles.

Plate-type nozzles for directing liquid flow are disclosed, for example, in U.S. Pat. Nos. 4,647,212 (Hankison) and 3,432,357 (Dankese). Other plate-type devices for controlling or directing liquid flow are disclosed, for example, in U.S. Pat. No. 5,014,750 (Winchell et al.); and U.S. Pat. No. 5,176,360 (Winchell et al.).

Although the foregoing references disclose nozzles, the references do not disclose nozzles for atomizing liquids.

Although generally simpler in design than non-plate nozzles, many conventional plate-type nozzles are still too complex and bulky in structure. For example, many conventional plate-type nozzles require the use of multiple plates and/or multiple surfaces of one or more plates. In addition, the plates used in many conventional plate-type nozzles are relatively thick and relatively expensive to make, machine and/or replace.

It would be desirable, therefore, to further simplify the structures of plate-type nozzles used for atomizing liquids. Furthermore, it would be desirable to provide a plate-type nozzle which can atomize a liquid by means of a single surface of a single plate. In addition, it would be desirable to provide a plate-type nozzle for atomizing liquids, wherein the nozzle is composed of one or more relatively thin plates.

In a nozzle designed for the atomization of liquids, mechanical energy is applied to a jet stream of the liquid to be atomized. The mechanical energy causes the jet stream to break up into discrete volumes of the liquid, the discrete volumes exiting the nozzle as drops.

The uniformity of the drop size of the atomized liquid is often important to the usefulness of the liquid in certain applications. For example, atomized liquids used in ink jet printers and fuel injection engines are generally required to contain drops of a substantially uniform size. Drops of a non-uniform size tend to lead to messy printed characters in ink jet printing applications and to decreased control over the combustion process carried out in a fuel injection engine. Therefore, it is continually desirable to provide nozzles capable of forming atomized liquids having drops of a substantially uniform size.

The present invention is based in part on the discovery that oscillation of the jet stream as the stream is being broken up into discrete volumes of liquid in the nozzle results in the formation of substantially uniform drop size in the atomized liquid.

The use of oscillation to form and direct jet streams is disclosed in Humphrey, Eugene F. and Tarumoto, Dave H., *Fluidics*, Fluid Amplifier Associates, Boston, Mass., 1965, pp.11--16, which is hereby incorporated by reference herein in its entirety. However, this reference does not teach the use of oscillation in a nozzle used to form atomized liquids, that is, a spray nozzle designed to convert a liquid stream into a plurality of drops, particularly a plurality of drops having substantially uniform size. In addition, the use of conventional fluidic oscillators tends to further increase the bulkiness of nozzle systems with which such oscillators are used.

Therefore, it would be further desirable to provide a plate-type nozzle for atomizing liquids, wherein the nozzle itself can provide pressure oscillation and does not require the use of a separate pressure oscillator. In addition, it would be desirable to provide a simplified plate-type nozzle for atomizing liquids wherein the nozzle can be used with a conventional pressure oscillator.

Accordingly, a primary object of this invention is to provide a plate-type liquid-atomizing nozzle which is relatively easy and inexpensive to make, inspect, clean, re-use and/or replace as compared to prior art nozzles.

A further object of this invention is to provide a plate-type nozzle which is capable of producing atomized liquids containing drops of a substantially uniform size.

Another object of this invention is to provide a plate-type nozzle for atomizing a liquid, wherein atomization can be carried out by means of a single plate.

A still further object of this invention is to provide a plate-type nozzle for atomizing a liquid, wherein atomization can be carried out on a single surface of a single plate.

Another object of this invention is to provide a plate-type nozzle for atomizing liquids, wherein the nozzle itself can provide pressure oscillation and does not require the use of a separate pressure oscillator.

A still further object of this invention is to provide a plate-type nozzle for atomizing liquids, wherein the nozzle can be used with a conventional pressure oscillator.

Another object of this invention is to provide a method of atomizing a liquid by means of a plate-type nozzle having the characteristics described in the foregoing objects.

These and other objects which are achieved according to the present invention can be readily discerned from the following description.

SUMMARY OF THE INVENTION

The present invention is directed to a plate-type nozzle and method of using the nozzle to atomize liquids. Atomized drops having a uniform diameter size can be achieved by means of the nozzle and method of this invention because of the use in the nozzle of an oscillating-pressure wave-forming component, wherein such component can be composed of a pressure oscillator formed in the common facial surface of the nozzle plate(s) or control-channels formed in the common facial surface and disposed in fluid communication with an external oscillation means, e.g. a pump or a sound source.

One aspect of the present invention is directed to a plate-type nozzle containing at least one nozzle plate having formed on a common facial surface thereof at least one atomization chamber comprising:

an inlet for a liquid stream;

a jet-forming channel downstream of and in fluid communication with the inlet, the jet-forming channel being adapted to convert the stream into a jet;

an interaction channel downstream of and in fluid communication with the jet-forming channel and having opposite first and second sides, the jet passing between the first and second sides and forming an attachment to either the first or second side;

a split path having first and second branch channels associated with the respective first and second sides of the interaction channel, wherein attachment to the first side causes the jet to flow entirely into the first branch channel while attachment to the second side causes the jet to flow entirely into the second branch channel;

at least one control channel in fluid communication with the interaction channel at the first and second sides; wherein an oscillating pressure wave is induced in the control channel which causes the attachment of the jet to switch back-and-forth between the first and second sides, respectively; the back-and-forth attachment-switching causing the jet to form substantially discrete liquid volumes in the first and second branch channels; and one or more outlet ports in communication with the branch channels for the liquid volumes, the volumes exiting the one or more outlet ports as substantially discrete atomized drops.

This invention is also directed to a method of atomizing a liquid stream by means of the nozzle of this invention. The method of this invention generally involves passing the liquid stream through the at least one atomization chamber from the inlet to the one or more outlet ports and inducing in the control channel an oscillating pressure wave which causes the attachment of the jet to switch back-and-forth between the first and second sides, respectively; the back-and-forth attachment-switching causing the jet to form substantially discrete liquid volumes in the first and second branch channels.

The plate-type nozzle provided by the present invention is relatively easy and inexpensive to make, clean, re-use and replace. Furthermore, the nozzle of this invention is capable of forming an atomized liquid from a liquid stream by means of a single plate. In addition, the nozzle of this invention is capable of forming an atomized liquid from a liquid stream by means of a single surface of a single plate.

Furthermore, by means of the plate-type nozzle and method of this invention, a liquid can be atomized to form droplets having a substantially uniform size.

DETAILED DESCRIPTION OF THE INVENTION

Figure 1:
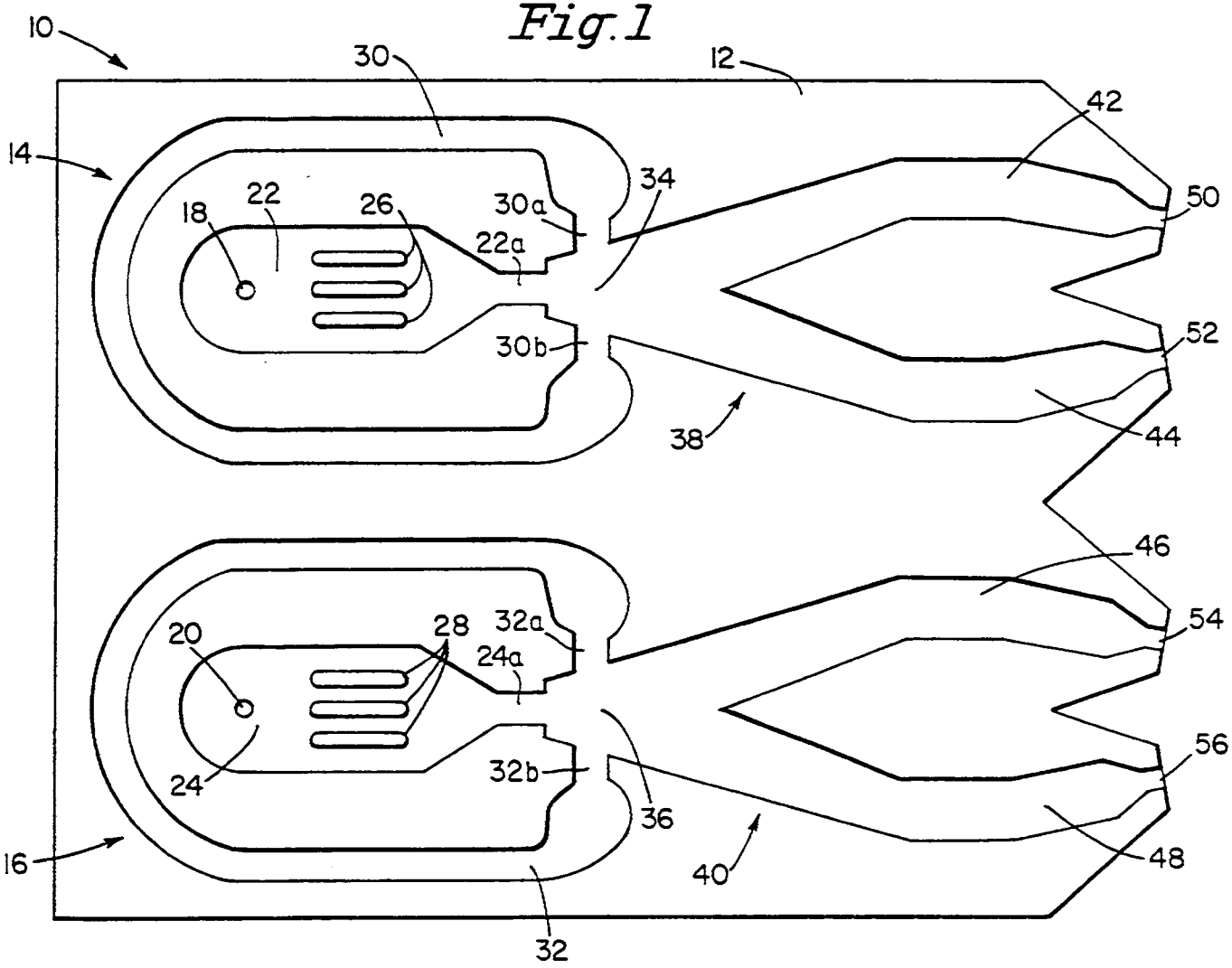
FIG. 1 represents a schematic illustration of a top plan view of a first embodiment of a nozzle plate within the scope of the present invention.

The term "liquid" as used herein refers to any fluid which can be atomized, including liquid/solid slurries.

The plate-type nozzle of this invention contains at least one nozzle plate which has formed on a common facial surface thereof at least one atomization chamber.

The inlet by which the liquid stream to be atomized is introduced into the atomization chamber is preferably a through-hole formed in either the nozzle plate itself or in a cover plate disposed over the atomization chamber.

After entering the atomization chamber through the inlet, the liquid stream is then passed through the jet-forming channel wherein the liquid stream is converted into a liquid jet. The term "jet" as used herein refers to a high-velocity liquid exiting an orifice under pressure. The jet-forming channel has a configuration which is suitable for converting the stream into a jet. Generally, to convert the liquid stream into a jet, the configuration of the jet-forming channel will be such as to cause the velocity of the liquid stream to increase, wherein the increase in velocity is the result of a substantial portion of the pressure energy of the liquid stream being converted into velocity energy. Preferably, the jet-forming channel will be a venturi such as that shown, e.g., in FIGS. 1–3 herein. The particular channel dimensions and velocity and pressure values required to convert a liquid stream into a jet will depend on the particular liquid involved and can be determined by those skilled in the art without undue experimentation.

Disposed downstream of and in fluid communication with the jet-forming channel is the interaction channel. The jet enters the interaction channel at reduced pressure and high speed and is directed to the centerline of the channel. The interaction channel has opposite first and second sides. As the jet passes between the first and second sides of the interaction channel, the jet forms an attachment to either the first side or the second side. Attachment of the Jet to the first side causes the jet to flow entirely into a first branch channel while attachment to the second side causes the jet to flow entirely into a second branch channel. The first and second branch channels are contained in a split path disposed downstream of and in fluid communication with the interaction channel. Preferably, the split flow path is formed by splitting a downstream end of the interaction channel.

Preferably formed in the first and second sides of the interaction channel are first and second side-ports, respectively. These side-ports are the preferred means by which the control channel, discussed in greater detail hereinbelow, is disposed in fluid communication with the interaction channel.

The pressure-oscillation component of the nozzle of this invention is composed of one or more control channels in which an oscillating pressure wave is formed. Preferably, the control channel(s) contains a control fluid, preferably a control gas, wherein the wave is created.

The control channel(s) is disposed in fluid communication with the interaction channel at the first and second sides of the interaction channel.

Figure 2:
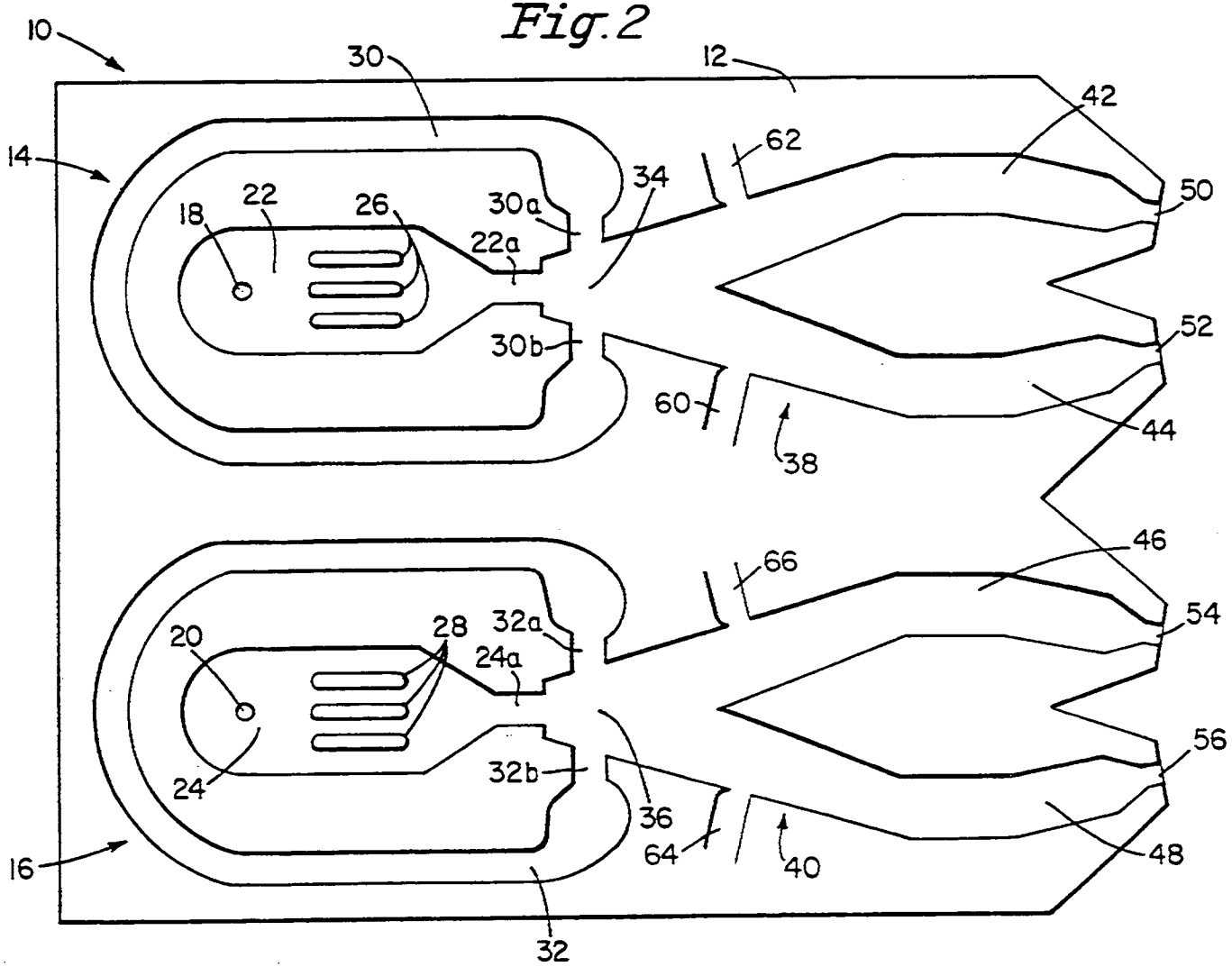
FIG. 2 represents a schematic illustration of a top plan view of a second embodiment of a nozzle plate within the scope of the present invention.

In one embodiment, the control channel is in the form of a single feedback loop as shown, e.g., in FIGS. 1 and 2. In this embodiment, the control channel(s) has a first end and an opposite second end, wherein the first end opens into the first side-port of the interaction channel and the second end opens into the second side-port of the interaction channel. The length of the feedback loop is preferably approximately equal to a half wavelength, or less for high frequencies.

Figure 3:
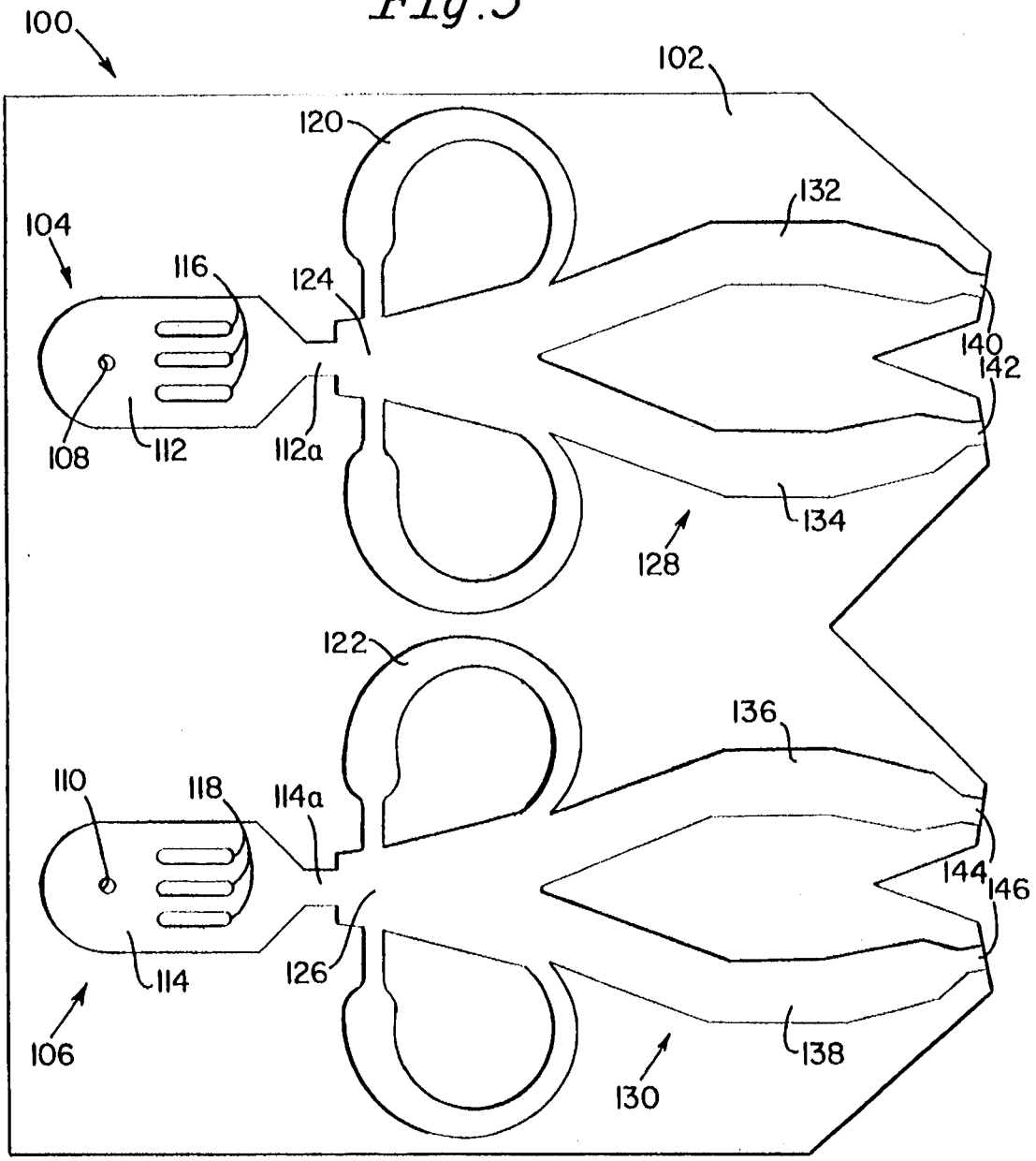
FIG. 3 represents a schematic illustration of a top plan view of a third embodiment of a nozzle plate within the scope of the present invention.

In another embodiment, the control channel is composed of two feedback loops as shown, e.g., in FIG. 3. In this embodiment, a first feedback loop has two ends, wherein a first end opens into a side-port formed in a side of the first branch channel and the second end opens into the first side-port formed in the interaction channel. A second feedback loop likewise has two ends, wherein a first end opens into a side-port formed in a side of the second branch channel while a second end opens into the second side-port formed in the interaction channel.

In another embodiment, the control channel is in the form of first and second micromachined control subchannels extending, respectively, from the first and second side-ports formed in the respective first and second sides of the interaction channel to a pressure oscillator, e.g., a pump or a sound source, disposed externally to the nozzle. Thus, in this embodiment, the control channel(s) contains a first control subchannel and a second control subchannel, wherein the first control subchannel has a first end disposed in fluid communication with a pressure oscillator and a second end disposed in fluid communication with the first side-port of the interaction channel, while the second control subchannel has a first end disposed in fluid communication with the pressure oscillator and a second end disposed in fluid communication with the second side-port in the interaction channel.

In the present invention, an oscillating pressure wave in the control pressure may be induced in the control channel by the passage of the jet through the interaction channel between the first and second side-ports formed in the sides thereof. When the passage of the jet between the first and second side-ports is to be used to induce formation of the oscillating pressure wave, the control channel(s) will preferably be in the form of a feedback loop or loops as discussed hereinabove and as shown in FIGS. 1–3 herein. For example, with the feedback loop shown in FIG. 3, as the jet stream passes down a branch channel disposed on one side of the interaction channel, the jet captures ambient air molecules present in the regions surrounding the jet and pulls the captured molecules into the feedback loop, where the molecules then induce oscillation. The oscillation causes the Jet to switch to the opposite side of the interaction channel, where this sequence is repeated. With the control channel shown in FIGS. 1 and 2, which is similar to that shown in FIG. 3 except that the former uses only one feedback loop to connect the first and second side-ports of the interaction channel, when the jet switches to the first side of the interaction channel, a rarefaction wave is propagated in the first side-port and a pressure wave develops in the second side-port on the opposite second side of the interaction channel. These waves cross each other and when the waves arrive at the opposite side-ports, the jet is switched.

In another embodiment, an oscillating pressure wave may be induced in the control channel by means of a pressure oscillator disposed in fluid communication with the control channel as discussed previously herein.

The oscillating pressure wave deflects the jet's flow through the interaction channel and causes the attachment of the jet to switch back-and-forth between the first and second sides of the interaction channel, respectively. This back-and-forth attachment-switching of the jet causes the jet to form substantially discrete liquid volumes in the first and second branch channels. These liquid volumes then exit the one or more outlet ports as substantially discrete atomized liquid drops.

The entrainment properties of the jet allow the oscillating pressure wave to deflect the jet's flow in the interaction channel. The entrainment properties of the jet force the jet to attach to either the first or the second side of the interaction channel. As mentioned above, the entire jet will flow into the branch channel which is situated on the same side to which the jet has attached. The attachment of the jet is preferably switched (i.e., deflected) from one side to the other side by introducing a sufficient pressure, via the control channel, on the side to which the jet has attached. The pressure is sufficient to cause the jet to detach from one side, move to the opposite side, and attach to the opposite side. The jet can then be detached from the opposite side and reattached to the first side in the same manner.

As mentioned hereinabove, the first and second branch channels may each have a side vent formed in a side thereof. This embodiment is illustrated, e.g., in FIG. 2 herein. The presence of such side vents tends to prevent changes in downstream conditions and disturbances which can adversely affect the flow of the jet through the interaction channel.

Another aspect of the present invention is directed to a method of atomizing a liquid by means of the plate-type nozzle of this invention. The method of this invention generally involves passing the liquid stream through the atomization chamber(s) from the inlet to the one or more outlet ports and inducing in the control channel an oscillating pressure wave which causes the attachment of the jet to switch back-and-forth between the first and second sides, respectively. The back-and-forth attachment-switching causes the jet to form substantially discrete liquid volumes in the first and second branch channels. These discrete liquid volumes exit the outlet port(s) as drops having a substantially uniform size.

Preferably, in the present invention, the control fluid in the control channel(s) is oscillated at a uniform frequency, because uniform frequencies promote the formation of uniformly sized atomized droplets. However, frequency variations may be used when a specific distribution of non-uniform droplet sizes is desired. The atomized drops formed in accordance with the present invention have a substantially uniform diameter size ranging from about 2.0 microns to about 500 microns and more preferably from about 100 microns to about 200 microns.

The shape of the jet emerging from the downstream end of the jet-forming channel will generally correspond to the shape of the downstream end. However, as the jet moves away from this end, high velocity fluid molecules at the edge of the jet collide with lower velocity "ambient" molecules present in the regions surrounding the jet. This interaction causes the jet to spread and decrease in velocity as the momentum of the jet molecules is shared with an increasing number of ambient molecules which are caught up or entrained in the jet. This entrainment removes molecules from the ambient regions on either side of the jet. However, because at constant temperature, pressure will depend on the number of molecules in a given volume, any molecules which are entrained by the jet must be replaced if pressure is to be maintained. The replenishing flow of other molecules into the ambient regions will be limited by the presence, if any, of cover plates on the top and bottom of the nozzle plate and by the sides of the interaction channel if the sides are positioned fairly close to the jet. Under such circumstances, replenishment of molecules into the ambient regions can occur only through the side-ports formed in the sides of the interaction channel and from the branch channels in the opposite direction from the jet and between the jet and the sides.

As stated previously herein, the jet forms an attachment to one or the other of the sides of the interaction channel. For the jet to attach to a side, the jet will preferably have a turbulent flow and move under a pressure within a designated range. In addition, the sides of the interaction channel will be preferably positioned so that the counterflow required to replace the ambient molecules entrained by the jet is insufficient. On a first side of the jet, control gas (preferably air) in the interaction channel will be removed faster than it can be replaced. The instant this occurs, the pressure on this side of the jet will decline. The pressure on the other side of the jet will not change because the counterflow on this other side is sufficient to offset the entrainment. The resulting pressure difference, or "transverse pressure gradient", between the two sides of the jet will cause the jet to move toward the lower-pressure side. As this happens, the counterflow to the lower-pressure side will decline further because the space between the jet and this side will be restricted by the movement of the jet, which results in a further increase of the pressure differential. This self-reinforcing process will cause the jet to quickly attach to the lower-pressure side.

A low pressure vortex region is formed between the jet and the point of attachment of the jet to a side, e.g., the first side of the interaction channel. The pressure differential between the outer edge of the jet and the low pressure vortex region maintains the jet's attachment to the first side. In the absence of any changes, this equilibrium condition will allow the jet to flow along the first side continually. To change this condition, the pressure in the low pressure vortex region may be increased until the pressure therein exceeds the pressure on the outer edge of the jet. This can be accomplished, e.g., by injecting additional amounts of the control fluid through the side-ports of the interaction channel and into the low pressure vortex region. If the rate at which the control gas is injected into the low pressure vortex region exceeds the rate at which gas is removed by entrainment, the pressure on the inner edge of the jet will increase. If this pressure becomes greater than the pressure on the outer edge of the jet, the former pressure differential is reversed and the jet will be forced to detach from the first side, cross the interaction channel, and attach to the second side of the interaction channel.

The frequency of the oscillating pressure wave in the control channel can be altered in several ways. For example, lengthening or shortening the feedback loops will respectively decrease or increase the frequency. However, the frequency will also respond to changes in the temperature and viscosity of the liquid. For example, increasing liquid temperature will increase the frequency, while increasing liquid viscosity will decrease the frequency.

The atomization chamber(s) disposed in the nozzle plate(s) of the nozzle of this invention preferably has a depth of from about 10% to about 80%, more preferably from about 20% to about 75%, and most preferably from about 30% to about 70%, of the thickness of the nozzle plate in which the chamber is formed.

In preferred embodiments, the atomization chamber further contains a flow straightening means, most preferably disposed in the jet-forming channel as illustrated in FIG. 1. The jet-forming channel is preferably a venturi and the flow-straightening means is preferably disposed adjacent a converging portion of the venturi. Preferably, the flow-straightening means are made up of a plurality of spaced baffles.

The nozzle plate(s) used in the nozzle of this invention can be metal or non-metal. Suitable non-metals include, e.g., thermoplastic resins. Suitable metals include, e.g., stainless steel, aluminum, aluminum-based alloys, nickel, iron, copper, copper-based alloys, mild steel, brass, titanium and other micromachinable metals.

Preferably, the nozzle plate(s) is composed of a material which is inert to the liquid stream passing through the plate(s). Because of its inertness and the relatively low cost associated with its use, stainless steel is a particularly useful metal in the nozzle of this invention.

The nozzle plate(s) used in the nozzle of this invention is preferably thin, with the plate(s) preferably having a thickness of from about 0.001 inch to about 1.0 inch. More preferably, each nozzle plate will have a thickness ranging from about 0.01 to about 0.25 inch and most preferably from about 0.01 inch to about 0.10 inch.

The nozzle plate(s) may have any suitable shape. Preferably, the nozzle plate(s) will have a square shape or a rectangular shape.

The atomization chamber(s) is preferably formed in the common facial surface of the nozzle plate by means of a micromachining process. Non-limiting examples of suitable micromachining processes include etching, stamping, punching, pressing, cutting, molding, milling, lithographing, and particle blasting. Most preferably, the atomization chamber(s) is formed by an etching process. Etching, e.g., photochemical etching, provides precisely formed parts while being less expensive than many other conventional machining processes. Furthermore, etched perforations generally do not have the sharp corners, burrs, and sheet distortions associated with mechanical perforations. Etching processes are well known in the art and are typically carried out by contacting a surface with a conventional etchant.

In the nozzle of the present invention, the nozzle plate(s) may contain one atomization chamber or a plurality of atomization chambers disposed in a side-by-side configuration.

In addition, the nozzle of this invention may contain a single nozzle plate or a plurality of nozzle plates. The plurality of nozzle plates can be arranged in a side-by-side stacked configuration or in a face-to-face stacked configuration.

As mentioned previously herein, the nozzle of this invention preferably contains a cover plate which functions as a "roof" to enclose the atomization chamber(s) formed in a facial surface of the nozzle plate. The cover plate can have the same dimensions as the nozzle plate and can be composed of the same material. Preferably, the cover plate will be composed of a transparent material to permit visual observation of the atomization process occurring in the nozzle plate. A particularly suitable transparent material for use in the cover plate is Lexan® polycarbonate, available from General Electric Company.

The nozzle and method of this invention will now be described with reference to FIGS. 1–3 herein.

FIG. 1 is a schematic representation of a nozzle plate useful in the nozzle and method of the present invention. Nozzle plate 10 has formed on a facial surface 12 thereof two atomization chambers 14 and 16 arranged in a side-by-side configuration. Atomization chambers 14 and 16 contain respective inlet ports 18 and 20; respective jet-forming channels 22 and 24; respective downstream ends **22*a* and 24*a* of jet-forming channels 22 and 24; respective flow straightening means 26 and 28; respective control channels 30 and 32; respective interaction channels 34 and 36; and respective split paths 38 and 40. Split path 38 is composed of a pair of branch channels 42 and 44, while split path 40 is composed of a pair of branch channels 46 and 48. Branch channels 42, 44, 46 and 48 terminate at respective outlet ports 50, 52, 54 and 56. Each of the control channels 30 and 32 is composed of one feedback loop connecting the side-ports, i.e., feedback loop channel 30 connects side-ports 30*a* and 30*b*, and feedback loop channel 32 connects side-ports 32*a* and 32*b***.

In FIGS. 1–3, the branch channels may be tilted away from adjacent branch channels.

With respect to FIG. 1, the method of this invention will be described with reference to atomization chamber 14, although it is to be understood that the method is equally applicable to atomization chamber 16. A liquid stream (not shown) is introduced into chamber 14 via inlet port 18. Under pressure, the liquid stream is passed through jet-forming channel 22, where the flow of the stream is straightened by means of flow straightening raised slit portions 26. As the stream flows through jet-forming channel 22, the flow velocity of the stream increases such that the liquid stream becomes a liquid jet stream in downstream end 22*a*. The flow of the jet stream through interaction channel 34 and past side-ports 30*a* and 30*b* induces the formation of an oscillating pressure wave in a control fluid (not shown) disposed in control channel 30. The oscillating pressure wave forces the liquid jet stream into one of the branch channels 42 or 44 in split path 38. As the pressure wave in the control fluid oscillates back and forth through control channel 30, the jet is alternately switched between the two branch channels 42 and 44. In other words, if pressure is higher at side-port 30*a*, the pressure wave will be disposed at side-port 30*a* and the jet will be caused to flow into branch channel 44; whereas if pressure is higher at side-port 30*b*, the pressure wave will be disposed at side-port 30*b* and the jet will be caused to flow into branch channel 42. Thus, the back-and-forth movement of the oscillating pressure wave causes the flow of the jet into split path 38 to switch repeatedly between branch channels 42 and 44.

When the jet switches to a first side, e.g., the side in which side-port 30*a* is formed, a rarefaction wave is propagated in side-port 30*a* and a pressure wave develops in the opposite side-port 30*b* on the opposite side of the interaction channel. These waves cross each other and when they arrive at the opposite side-ports, the jet is switched from the first side-port 30*a* to the second side-port 30*b*.

FIG. 2 represents a second embodiment of a nozzle within the scope of this invention, wherein the nozzle shown in FIG. 2 is identical to the nozzle illustrated in FIG. 1 except that the nozzle in FIG. 2 further contains side vents 60 and 62 formed in respective branch channels 44 and 42 and side vents 64 and 66 formed in respective branch channels 48 and 46. The presence of these side vents isolates interaction channels 34 and 36 from downstream conditions which might adversely affect the flow of the jet.

FIG. 3 represents a third embodiment of a nozzle within the scope of the present invention. Nozzle plate 100 has formed on a facial surface 102 thereof two atomization chambers 104 and 106 arranged in a side-by-side configuration. Atomization chambers 104 and 106 contain respective inlet ports 108 and 110; respective jet-forming channels 112 and 114; respective downstream ends 112*a* and 114*a* of jet-forming channels 112 and 114; respective flow straightening means 116 and 118; respective control channels 120 and 122; respective interaction channels 124 and 126; and respective split paths 128 and 130. Split path 128 is composed of a pair of branch channels 132 and 134, while split path 130 is composed of a pair of branch channels 136 and 138. Branch channels 132, 134, 136 and 138 terminate at respective outlet ports 140, 142, 144 and 146. Loop-shaped control channel 122 is disposed in fluid communication with interaction channel 124 via side-ports 120*a* and 120*b*. Control channel 120 is also disposed in fluid communication with respective branch channels 132 and 134 at side vents 120*c* and 120*d*. Loop-shaped control channel 122 is disposed in fluid communication with interaction channel 126 via side-ports 122*a* and 122*b*. Control channel 122 is also disposed in fluid communication with respective branch channels 136 and 138 at side vents 122*c* and 122*d*. In FIG. 3, the flow of the jet stream through interaction channel 124 and past side-ports 120*a* and 120*b* induces the formation of an oscillating pressure wave in a control fluid (not shown) disposed in control channel 120. The oscillating pressure wave forces the jet into one of the branch channels 132 or 134 in split path 128. A small part of the flow of the jet is captured in the feedback loop 120 as the stream passes down branch channel 132. This flow returns to the interaction channel 124 as a control stream which causes the jet to switch to the opposite side where this sequence is repeated.

Although the present invention has been described with reference to preferred embodiments, those skilled in the art will recognize that changes may be made in form and detail without departing from the spirit and scope of the invention.

What is claimed is:

1. A method for atomizing a liquid stream by means of a plate-type nozzle comprising at least one nozzle plate having formed on a common facial surface thereof at least one atomization chamber comprising:

an inlet for a liquid stream;

a jet-forming channel downstream of and in fluid communication with said inlet, said jet-forming channel being adapted to convert said stream into a jet;

an interaction channel downstream of and in fluid communication with said jet-forming channel and having opposite first and second sides, said jet passing between said first and second sides and forming an attachment to either said first or second side;

a split path having first and second branch channels associated with said respective first and second sides of said interaction channel, wherein attachment to said first side causes said jet to flow entirely into said first branch channel while attachment to said second side causes said jet to flow entirely into said second branch channel, said first and second branch channels terminating in first and second outlet ports, respectively, wherein said first and second outlet ports are open to an ambient environment such that liquid passing through said first and second outlet ports exits said nozzle and enters said ambient environment; said first and second outlet ports being formed in a downstream edge of said common facial surface such that flow through said outlet ports and flow through said branch channels both occur on said common facial surface and are both directed toward said downstream edge: said downstream edge being disposed downstream relative to said inlet; and at least one control channel in fluid communication with said interaction channel at said first and second sides;

wherein said method comprises:

(1) passing said liquid stream through said at least one atomization chamber from said inlet to said first and second outlet ports and inducing in said control channel an oscillating pressure wave which causes said attachment of said jet to switch back-and-forth between said first and second sides, respectively; said back-and-forth attachment-switching causing said jet to form substantially discrete liquid volumes in said first and second branch channels; and (2) directing said substantially discrete liquid volumes through said first and second outlet ports whereby said liquid volumes exit said nozzle and enter said ambient environment, said substantially discrete liquid volumes exiting said nozzle as substantially discrete atomized drops.

2. A method according to claim 1, wherein the oscillating pressure wave oscillates at a substantially constant frequency.

3. A method according to claim 2, wherein the atomized drops are of substantially uniform size.

4. A method according to claim 1, wherein the liquid stream further comprises solids suspended therein.

5. A method according to claim 1, wherein said jet-forming channel is a venturi.

6. A method according to claim 1, wherein said split path is formed by splitting a downstream end of said interaction channel.

7. A method according to claim 1, wherein a control fluid is disposed in said at least one control channel.

8. A method according to claim 7, wherein the control fluid comprises a gas.

9. A method according to claim 7, wherein said first side has formed therein a first side-port and said second side has formed therein a second side-port, further wherein said at least one control channel is disposed in fluid communication with said interaction channel at said first and second side-ports.

10. A method according to claim 9, wherein said oscillating pressure wave is induced in the control fluid by passage of the jet through the interaction channel past the first and second side-ports.

11. A method according to claim 10, wherein the at least one control channel comprises a single feedback loop, wherein the feedback loop comprises a first end and an opposite second end, wherein the first end communicates with the first side-port of the interaction channel and the second end communicates with the second side-port of the interaction channel.

12. A method according to claim 10, wherein the at least one control channel comprises a first feedback loop having first and second ends and a second feedback loop having first and second ends, wherein said first end of said first feedback loop opens into a side-port formed in a side of the first branch channel and the second end of said first feedback loop opens into the first side-port formed in the interaction channel; and said first end of said second feedback loop opens into a side-port formed in a side of said second branch channel and said second end of said second feedback loop opens into said second side-port formed in said interaction channel.

13. A method according to claim 1, wherein the at least one atomization chamber comprises a flow-straightening means.

14. A method according to claim 13, wherein the flow-straightening means is disposed in the jet-forming channel.

15. A method according to claim 1, wherein the at least one atomization chamber has been formed on the common facial surface of the at least one nozzle plate by an etching process.

16. A method according to claim 1, wherein the at least one nozzle plate has a thickness of from about 0.001 inch to about 1.0 inch.

17. A plate-type nozzle, comprising at least one nozzle plate having formed on a common facial surface thereof at least one atomization chamber comprising:

an inlet for a liquid stream;

a jet-forming channel downstream of and in fluid communication with said inlet, said jet-forming channel being adapted to convert said stream into a jet;

an interaction channel downstream of and in fluid communication with said jet-forming channel and having opposite first and second sides, said jet passing between said first and second sides and forming an attachment to either said first or second side;

a split path having first and second branch channels associated with said respective first and second sides of said interaction channel, wherein attachment to said first side causes said jet to flow entirely into said first branch channel while attachment to said second side causes said jet to flow entirely into said second branch channel, said first and second branch channels terminating in first and Second outlet ports, respectively, wherein said first and second outlet ports are open to an ambient environment such that liquid flowing through said first and second outlet ports exits said nozzle and enters said ambient environment; said first and second outlet ports being formed in a downstream edge of said common facial surface such that flow through said outlet ports and flow through said branch channels both occur on said common facial surface and are both directed toward said downstream edge; said downstream edge being disposed downstream relative to said inlet;

at least one control channel in fluid communication with said interaction channel at said first and second sides; wherein an oscillating pressure wave is induced in said control channel which causes said attachment of said jet to switch back-and-forth between said first and second sides, respectively; said back-and-forth attachment-switching causing said jet to form substantially discrete liquid volumes in said first and second branch channels;

said liquid volumes exiting said nozzle through said first and second outlet ports as substantially discrete atomized drops.

18. A plate-type nozzle according to claim 17, wherein said jet-forming channel is a venturi.

19. A plate-type nozzle according to claim 17, wherein said split path is formed by splitting a downstream end of said interaction channel.

20. A plate-type nozzle according to claim 17, wherein said first side of said interaction channel has formed therein a first side-port and said second side of said interaction channel has formed therein a second side-port, further wherein said at least one control channel is disposed in fluid communication with said interaction channel at said first and second side-ports.

21. A plate-type nozzle according to claim 20, wherein the at least one control channel comprises a single feedback loop, wherein the feedback loop comprises a first end and an opposite second end, wherein the first end communicates with the first side-port and the second end communicates with the second side-port.

22. A plate-type nozzle according to claim 21, wherein said first branch channel has a side-port formed in a side thereof, and said second branch channel has a side-port formed in a side thereof.

23. A plate-type nozzle according to claim 22, wherein the at least one control channel comprises a first feedback loop having first and second ends and a second feedback loop having first and second ends, wherein said first end of said first feedback loop opens into said side-port formed in said side of the first branch channel and the second end of said first feedback loop opens into the first side-port formed in the interaction channel; and said first end of said second feedback loop opens into said side-port formed in said side of said second branch channel and said second end of said second feedback loop opens into said second side-port formed in said interaction channel.

24. A plate-type nozzle according to claim 17, wherein the at least one atomization chamber comprises a flow-straightening means.

25. A plate-type nozzle according to claim 24, wherein the flow-straightening means is disposed in the jet-forming channel.

26. A plate-type nozzle according to claim 25, wherein said jet-forming channel is a venturi and said flow-straightening means is disposed adjacent a converging portion of said venturi.

27. A plate-type nozzle according to claim 25, wherein said flow-straightening means comprises a plurality of spaced baffles.

28. A plate-type nozzle according to claim 17, wherein the at least one atomization chamber has been formed on the common facial surface of the at least one nozzle plate by a micromachining process.

29. A plate-type nozzle according to claim 28, wherein the micromachining process comprises etching.

30. A plate-type nozzle according to claim 17, wherein the at least one nozzle plate has a thickness of from about 0.001 inch to about 1.0 inch.

31. A plate-type nozzle according to claim 30, wherein the at least one nozzle plate has a thickness of from about 0.01 inch to about 0.10 inch.

32. A plate-type nozzle according to claim 17, wherein the at least one nozzle plate comprises a plurality of the at least one atomization chamber disposed in a side-by-side configuration.

33. A plate-type nozzle according to claim 17, wherein the nozzle comprises a plurality of the at least one nozzle plate disposed in a side-by-side stacked configuration or in a face-to-face stacked configuration.

* * * * *